United States Patent [19]

Svensson

[11] 4,374,533

[45] Feb. 22, 1983

[54] APPARATUS FOR DEBARKING LOGS AND CUT TIMBER

[75] Inventor: Sven A. Svensson, Myckling, Sweden

[73] Assignee: Mo och Domsjo Aktiebolag, Ornskoldsvik, Sweden

[21] Appl. No.: 227,301

[22] Filed: Jan. 22, 1981

[30] Foreign Application Priority Data

Feb. 5, 1980 [SE] Sweden ..... 8000917

[51] Int. Cl.[3] ..... B21L 1/00

[52] U.S. Cl. ..... 144/208 B; 198/587

[58] Field of Search ..... 144/208 R, 208 B, 311, 144/242 R; 198/587; 241/171

[56] References Cited

U.S. PATENT DOCUMENTS 3,262,477 7/1966 O'Brien ..... 144/208 B 3,716,087 2/1973 Tuuha ..... 144/208 B

*Primary Examiner*—W. D. Bray

[57] ABSTRACT

Apparatus is provided for debarking logs and cut timber, comprising a debarking drum rotatable in either direction and having an inlet at one end and a plurality of lifter means shaped and disposed on an interior wall of the drum in a manner to engage and lift logs and cut timber with rotational movement of the drum in either direction; and a conveyor feeding logs and cut timber into the interior of the debarking drum; the conveyor being movable between a first position and a second position with respect to the inlet and the center axis of the debarking drum; and means for driving the drum in one direction when the conveyor occupies the first position, and in the opposite direction when the conveyor occupies the second position, so as to wear the lifter means more evenly.

11 Claims, 6 Drawing Figures

APPARATUS FOR DEBARKING LOGS AND CUT TIMBER

Cut timber or logs are debarked in the interior of a debarking drum and the inlet opening is so dimensioned that the logs can be fed freely into the drum at a rate according to their length, so as to feed one log or timber unit per second. Thus, a log having a length of 5 meters is fed in at a speed of 5 m/s. The drum always rotates in only one direction, and while it rotates the logs are carried up with it by log lifters arranged on the interior wall thereof. The log lifters have the form of sheet metal blades, or ridges which are bent or shaped so as to project outwardly from the inner surface of the drum, and are, for example, triangular or semicircular in cross-section. The lifters carry the logs at the bottom of the drum up to an upper part of the drum, whence the logs fall back down to the bottom, and in so doing the bark is partially pulled loose and partially broken off, and the loose bark is discharged through openings in the drum.

In debarking apparatus of this kind, since the drum constantly rotates in only one direction, the same side surface of the leg lifters always works against the logs, and is worn down, while the other side surface will not be worn at all. When there is heavy wear on one side of the log lifters (a wear approximately half the metal thickness, in the case of hollow log lifters) the entire drum must be replaced. The useful life of such a drum is about six years. At present prices, a drum replacement can cost approximately $750,000.

In accordance with the invention, the lifter means are made to wear more evenly on each side by arranging the drum for rotation in either direction, and then rotating it in each direction for approximately equal periods of time. This enables the useful life of the drum to be extended by about 50% or more. The cycling of the direction of rotation of the drum is governed by the feed of cut timber and logs to the drum. A conveyor for feeding cut timber and logs into the drum is movable between a first position and a second position with respect to the inlet opening of the drum, the first position being located on one side of the center axis of the drum, and the second position being located on the other side, and drive means rotates the drum in one direction when the conveyor is in the first position, and rotates the drum in the opposite direction when the conveyor is in the second position.

By rotating the debarking drum in either direction, the log lifters are worn on both working surfaces and so the working life of the lifters can be increased by 100%. In practice, however, the working life of a debarking drum according to the invention will be increased by about 50%, since between the two working surfaces there is a common transition surface, which is subjected to a certain amount of wear irrespective of the direction in which the drum rotates.

The drawings illustrate preferred embodiments of the invention, in which.

Figure 1:
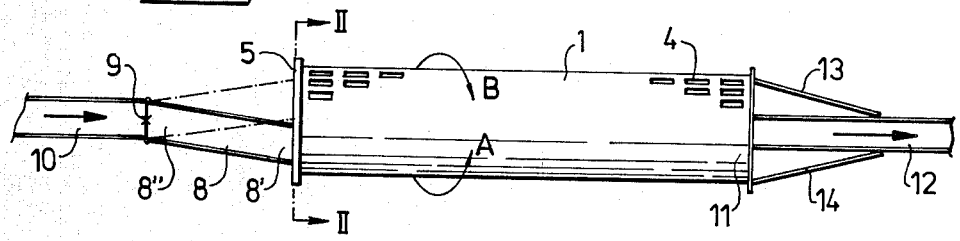
FIG. 1 is a greatly simplified top view of one embodiment of a debarking apparatus according to the invention.
Figure 2:
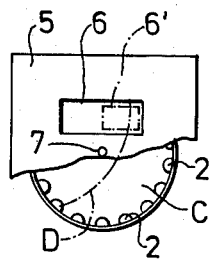
FIG. 2 is a cross-section with part cut away, taken on the line II—II in FIG. 1.
Figure 5:
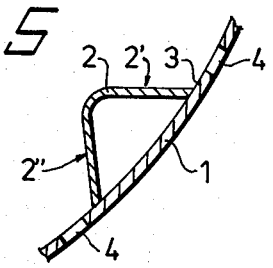
FIG. 5 is a cross-sectional view on an enlarged scale of a log lifter and an adjacent part of the drum of the embodiment of FIG. 1.

The rotatable cylindrical debarking drum 1 shown in FIG. 1 has an open interior with the inner wall surface thereof provided with a plurality of axially extending, rectilinear debarking elements or log lifters 2. As seen in FIGS. 2 and 5, these comprise V-shaped channels with sides 2', 2'' whose long edges are welded to the inner surface 3 of the drum 1, or are attached to that surface in some other suitable fashion. The cylindrical wall of the debarking drum is foraminous, with elongated openings or slots 4 through which bark, earth, etc., torn from the logs can escape from the drum.

The left-handed end of the drum 1 is entirely open, and abuts the stationary baffle 5, which has a rectangular opening 6 therethrough leading into the interior of the drum 1. The drum 1 mounted for rotation in the baffle 5 in conventional manner not specifically shown, and is inclined at a slight angle to the horizontal, so as to feed the logs or timber forward downwardly by gravity. As is best seen in FIG. 2, the inlet opening 6 is located above the center axis 7 of the drum 1, and extends horizontally outwardly on both sides of the axis 7.

Connecting with the inlet opening 6 is a feed conveyor 8 (FIG. 1), which can be swung about a center axis 9 between a first position (illustrated in full lines) and a second position (illustrated in dashed lines). When the conveyor 8 occupies the first position, the drum end 8' of the conveyor is located opposite the right-hand half 6' of the inlet opening 6. When the conveyor 8 occupies the second position, the drum end 8' is located opposite the left-hand half 6'' of the opening 6.

The conveyor 8 receives logs from a conveyor 10 of conventional kind, for example a driven roller belt, chain conveyor or belt conveyor. The feed conveyor 8 may be of any of the aforementioned conveyor types, but in the drawings as shown is a roller conveyor with driven rollers.

The debarking drum 1, which is inclined slightly downwardly from the baffle 5 to the outlet end 11, can be partially closed off, with an outlet opening at the outlet end, or fully open at that end. Debarked timber and logs are discharged onto a conveyor 12, with upwardly extending guide plates 13 and 14 at the end thereof nearest the drum, to ensure that logs leaving the drum are positively guided onto the conveyor 12. The conveyor 12 may be of any suitable kind, and may even be a chute.

As indicated in FIG. 1 by means of arrows A and B, the debarking drum can be driven for rotation either clockwise or counterclockwise. When the drum 1 is rotated in the direction of arrow A, timber and logs in the drum will move substantially within the cross-sectional region C (see FIG. 2), which in the FIG. 2 embodiment is limited by a line D, and the logs are lifted on the leading surfaces 2' (FIG. 5) of the log lifters 2, as seen in the direction of rotation. Thus, in this direction of rotation the trailing surfaces 2'' will not be subject to wear.

As will also be seen from FIG. 2, when the drum 1 is rotated in the direction A, the right-hand half 6' of the inlet opening 6 will be completely or partially blocked by the ends of the logs located in the drum, thereby preventing feed in through the half 6′ of the opening. Consequently, the feed conveyor 8 must be moved to the feed position illustrated in FIG. 1 in dashed lines, whereupon logs are fed into the drum through the free half of the opening, i.e., through the left-hand half 6″ of the opening (see FIG. 2). The logs, which have a length of, for example, 2.5 meters, are preferably fed into the drum at a speed corresponding to the length of the logs, i.e., in this case at a speed of 2.5 m/s, or at a rate of one log per second. The logs move forward through the drum 1 at a much lower speed, depending upon the angle at which the drum is inclined. The normal speed is about 2 to 5 m/minute.

After rotating the drum 1 in the direction A for a given period of time, for example one week, the direction of rotation of the drum is reversed, so that the drum rotates in the direction of the arrow B. The line D′ defining the angle of repose in FIG. 2 is the mirror image of the previous line D, and the logs are fed in to the drum through the right-hand half 6″, by moving the conveyor 8 to the position shown in full lines in FIG. 1. When the drum is rotated in the direction B, the log lifters 2 will be worn on the opposite surface 2″.

The useful life of the log lifters in an apparatus constructed in accordance with the invention is thus from 50% to 100% again as long as that of the log lifters of conventional apparatus in which the debarking drum is rotated in one direction only.

Although the full opening 6 of the illustrated embodiment has a rectangular shape, it will be understood that the said opening may have any suitable shape, for example, an elliptical shape. It is essential, however, that sufficient open volume be given on both sides of a vertical line through the central axis of the drum 1 and the opening 6 to permit timber and logs to be freely fed into the drum through either half-side of the opening.

Figure 3:
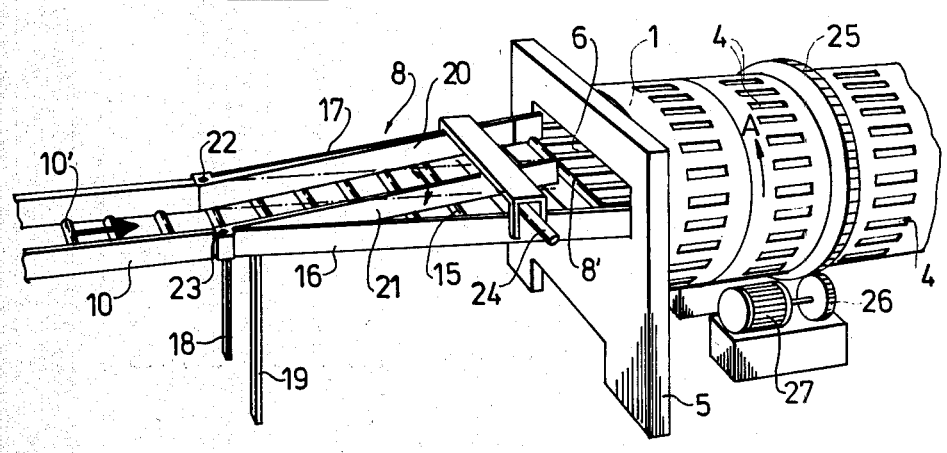
FIG. 3 is a perspective view of a feed conveyor and the end of a debarking drum connecting with the conveyor.

Another advantageous embodiment of a feed conveyor is illustrated in FIG. 3. In this embodiment, the conveyor 10, which is here assumed to comprise a roller conveyor with freely rotatable rollers 10′ journalled in a frame structure, connects with the feed conveyor 8*a*, which is provided with driven rollers 15 whose respective lengths progressively increase towards the drum 1, so that the length of the roller 15 located nearest the conveyor 10 corresponds substantially to the width of the conveyor 10, and the length of the roller 15 located nearest the opening 6 corresponds to the width of the opening. In the illustrated embodiment, all the rollers 15 are driven, and are journalled at respective ends thereof in two fixed beams 16 and 17, respectively.

Figure 6:
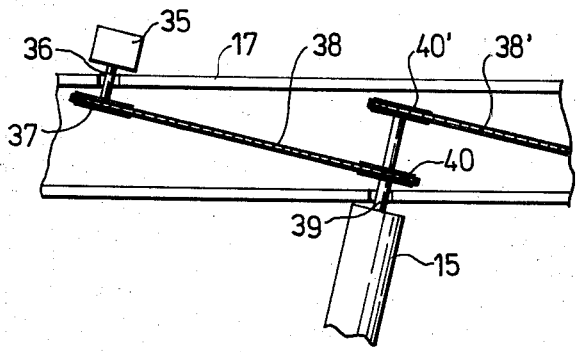
FIG. 6 is a simplified view of a drive means for the rollers of the feed conveyor of the embodiment of FIG. 1.

FIG. 6 illustrates the chain drive by which the rollers are driven. The beam 17 is a box beam, to which a motor 15 is mounted, the motor having a shaft 36 which extends into the interior of the beam, and which carries on its free end a sprocket drive wheel 37 over which an endless drive chain 38 extends. Each roller has an axle journal 39 which is freely rotatable in the beam and which carries on its free end sprocket wheels 40, 40′, driven by chains 38 and 38′. At one end thereof, the beams 16 and 17 are fixedly mounted in the baffle 5, and are supported at their other ends by supports 18, 19.

The end parts of the beams 16, 17 facing the conveyor 10 have two guide rails 20 and 21 pivotably mounted thereon. In the illustrated embodiment, the bearings on which the two guide rails 20, 21 pivot comprise two vertical shafts 22 and 23, respectively. The lower edges of the two guide rails 20, 21 lie above the rollers 15, and the guide rails can thus be swung freely from one end to the other over the rollers 15.

The two guide rails are arranged to be swung by means of an operating mechanism between a first position, shown in full lines in FIG. 3, in which the guide rail 20 lies against the beam 17, and a second position, shown in dashed lines, in which the guide rail 21 lies against the beam 16, and the guide rail 20 adopts the position. In the illustrated embodiment, the operating mechanism comprises a cylinder 24 having a piston rod (not shown) which is pivotably connected to the two guide rails and which, when fully extended, holds the guide rails in the illustrated position for feeding logs into the left-hand part 6″ of the opening 6, i.e., when the debarking drum 1 is driven in the direction of the arrow A. The drum 1 is provided along its axial length with circular drive bands 25, which are fixedly connected to the outer surface of the drum, and which co-act with drive rollers 26 arranged partly to support the drum 1 and partly to transmit rotary movement thereto. The drive rollers 26, which are coupled to the drive motor 27, are arranged on both sides of the drum 1.

Figure 4:
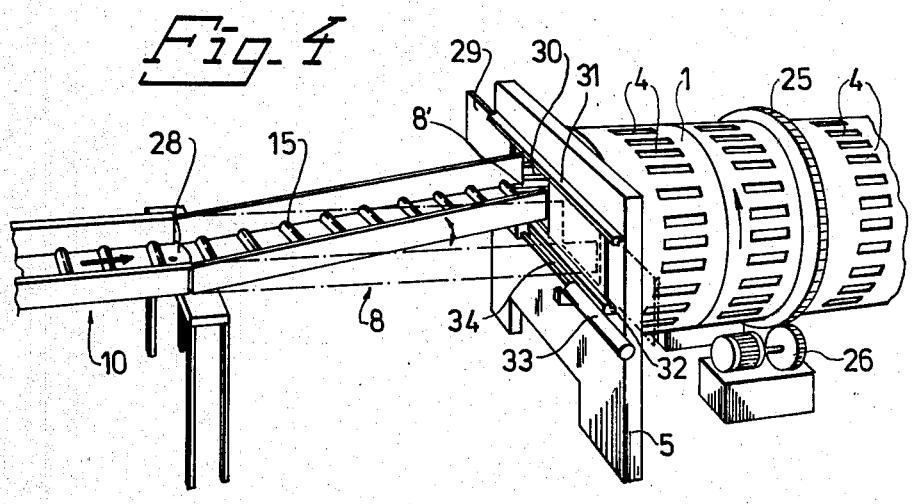
FIG. 4 is a perspective view of another embodiment of a feed conveyor.

FIG. 4 illustrates a further embodiment of a modified feed conveyor. In this embodiment, the conveyor 8*b* comprises a swingable roller track having driven rollers 15 whose respective lengths are the same as those of the rollers of the conveyor 10. The roller length suitably corresponds to from $\frac{1}{3}$ to $\frac{1}{2}$ the diameter of the drum. The roller track is pivotable or swingable about a shaft 28, and can be moved between the two positions described with reference to FIG. 1.

A protective plate 29 is connected to the feed end of the conveyor 8*b* and has an opening 30 which corresponds substantially to the halves 6′, 6″ of the opening 6 in the baffle 5. The protective plate 30 is slidably mounted in guides 31 and 32. Movement of the conveyor 8*b* between the two positions is effected by means of a hydraulic piston-cylinder arrangement comprising a cylinder 33 and a piston rod 34 which is coupled to the conveyor 8*b*. The feed conveyor 8*b* is preferably driven in a manner such that the logs or timber are accelerated to the desired final speed. To this end, the drive motor 18 is preferably arranged to operate at different speeds, depending upon the length of the logs or timber.

The invention is not restricted to the described and illustrated embodiments, but can be modified within the scope of the claims.

Thus, for example, the guide rails 20, 21 of the FIG. 3 embodiment can be replaced with a single guide rail pivotably mounted in front of the vertical center line of the opening 6. In this case, the free end of the guide rail is movable between positions corresponding to the positions of the illustrated shafts 22 and 23.

As previously mentioned, the opening 6 may have a shape different to that illustrated. Preferably, the largest possible width of the opening is slightly less than the diameter of the drum, since the opening lies above the center line of the drum.

The lifters illustrated are V-shaped ridges, made of inverted channels, but they can also have any cross-sectional configuration, e.g., square, rectangular, or dovetail, and they can also take the form of plates, lugs or blades, straight-sided, or curved, preferably double-faced outwardly concave.

Having regard to the foregoing disclosure, the following is claimed as patentable and inventive embodiments thereof:

1. Apparatus for debarking logs and cut timber, comprising a debarking drum rotatable in either direction and having an inlet at one end and an outlet at the other end; a plurality of lifter means shaped and disposed on an interior wall of the drum in a manner to engage and lift logs and cut timber with rotational movement of the drum in either direction; a conveyor feeding logs and cut timber into the interior of the debarking drum; the conveyor being movable between a first position and a second position with respect to the inlet and the center axis of the debarking drum; and means for driving the drum in one direction when the conveyor occupies the first position, and in the opposite direction when the conveyor occupies the second position, so as to wear the lifter means more evenly.

2. Apparatus according to claim 1 in which the drum is cylindrical.

3. Apparatus according to claim 1 having a baffle intermediate the conveyor and the inlet into the drum; the baffle having a through opening in alignment with the drum inlet and the conveyor in both positions of the conveyor.

4. Apparatus according to claim 3 in which the width of the baffle opening is twice the width of the conveyor, and the conveyor feeds through one half-side of the opening in the first position and through the other one half-side of the opening in the second position.

5. Apparatus according to claim 4 in which the opening is rectangular.

6. Apparatus according to claim 1 in which the outlet of the drum is in connection with means for delivering debarked logs and cut timbers to a receptacle.

7. Apparatus according to claim 1 in which the lifter means extend axially of the drum and project inwardly in a manner to provide lifting surfaces.

8. Apparatus according to claim 1 in which the conveyor has at least one pivotable guide means arranged over the conveying plane of the conveyor such that in a first position logs and cut timber are guided to one half portion of the drum inlet, and in a second position are guided to the other half portion of the drum inlet.

9. Apparatus according to claim 1 in which the end of the conveyor remote from the drum is pivotably mounted; and has drive means for pivoting the opposite end of the conveyor connecting with the inlet to the drum between said first and second positions.

10. Apparatus according to claim 1 in which the conveyor has a width that is from $\frac{1}{3}$ to $\frac{1}{2}$ the diameter of the drum.

11. Apparatus according to claim 1 in which the drum is inclined at an angle to the horizontal so as to feed the logs or timber forward downwardly by gravity towards the outlet end.

* * * * *